US005903985A

United States Patent [19]

DeMarchi

[11] Patent Number: 5,903,985

[45] Date of Patent: May 18, 1999

[54] SPORT BOOT PROVIDED WITH AN ADJUSTABLE ARCH SUPPORT, AND AN ADJUSTABLE ARCH SUPPORT THEREFOR

[75] Inventor: Jean-Louis DeMarchi, Saint-Jorioz, France

[73] Assignee: Salomon S.A., Metz-Tessy, France

[21] Appl. No.: 08/857,049

[22] Filed: May 15, 1997

[30] Foreign Application Priority Data

May 22, 1996 [FR] France ..... 96 06573

[51] Int. Cl.[6] ..... A43B 7/14; A61F 5/14

[52] U.S. Cl. ..... 36/155; 36/91; 36/150; 36/156; 36/160

[58] Field of Search ..... 36/88, 91, 145, 36/150, 155, 156, 157, 158, 159, 160, 169

[56] References Cited

U.S. PATENT DOCUMENTS

| | | | |
|---|---|---|---|
| 899,367 | 9/1908 | Winchell | 36/156 |
| 1,099,648 | 6/1914 | Hammann | 36/158 |
| 2,000,949 | 5/1935 | Heller | 36/156 |
| 2,055,399 | 9/1936 | Ahern | 36/160 |
| 2,075,942 | 4/1937 | Howell | 36/71 |
| 2,204,410 | 6/1940 | Ganzer | 36/156 |
| 4,166,329 | 9/1979 | Herbig | 36/97 |
| 4,731,940 | 3/1988 | Zanatta et al. | 36/91 |

FOREIGN PATENT DOCUMENTS

| | | | |
|---|---|---|---|
| 0222273 | 5/1987 | European Pat. Off. . | |
| 0409101 | 1/1991 | European Pat. Off. . | |
| 852733 | 3/1940 | France . | |
| 179431 | 12/1906 | Germany | 36/157 |
| 451060 | 10/1927 | Germany | 36/160 |
| 419349 | 11/1934 | United Kingdom | 36/158 |

*Primary Examiner*—M. D. Patterson
*Attorney, Agent, or Firm*—Greenblum & Bernstein, P.L.C.

[57] ABSTRACT

Sport boot including a sole overlaid by an upper, the boot having an internal support surface for the foot and a portion for supporting the arch of the user's foot, wherein the supporting portion is constituted by a flexible, elastically deformable element positioned between the internal support surface and an internal lateral flank of the upper, and wherein it includes a volume adjusting mechanism which it demarcates with the upper, by acting on its profile, along at least one transverse plane with respect to the longitudinal axis of the foot.

19 Claims, 2 Drawing Sheets

SPORT BOOT PROVIDED WITH AN ADJUSTABLE ARCH SUPPORT, AND AN ADJUSTABLE ARCH SUPPORT THEREFOR

BACKGROUND OF THE INVENTION

1. Field of the Invention

The present invention relates to an arch support for a boot, such as a sport boot including a sole overlaid by an upper provided with an opening to enable passage of the user's foot and having closure and tightening mechanism, including a sport boot incorporating such an arch support. The sole includes an external portion adapted to be in contact with the ground or with a sport accessory such as a cross-country ski, a conventional skate or an in-line roller skate.

Generally, a boot of the above-mentioned type has an internal sole portion, referred to as an internal or comfort sole, arranged directly beneath the user's foot. It is known to provide on this internal portion of the sole a zone for supporting the arch of the user's foot.

2. Background and Material Information

Such portions for supporting the arch of the foot are widely diffused and generally are constituted by a projection of the internal sole, made of a more or less flexible and elastic material along a standard profile for a given type of boot.

As a result, these supporting portions are not perfectly adapted to the morphology of the user's foot, and this may lead to a discomfort that could disturb the blood circulation in this zone of the foot.

To remedy this disadvantage, supporting portions for the arch of the foot have already been proposed which have certain adjustments.

Thus, the U.S. Pat. No. 2,075,942 proposes a supporting portion for the arch of the foot including adjusting means in a longitudinal direction so as to better adapt to the morphology of a given user.

Foot internal tightening means taking into account the morphology of the arch of a user's foot are also known from the Japanese Patent No 7-108002.

SUMMARY OF THE INVENTION

The object of the present invention thus relates to a boot, such as a sport boot including a sole overlaid by an upper. The boot has, on an internal surface, a supporting portion for the arch of the user's foot, wherein such a supporting portion includes a flexible, elastically deformable element connectively positioned between the internal surface and an internal lateral flank of the upper, and wherein it has a volume adjusting mechanism which it demarcates with the upper, along at least one transverse plane with respect to the longitudinal axis of the boot, in order to modify and adapt it to the profile of the arch of a user's foot, as a function of the shape and camber thereof within the limits of a predetermined adjustment range.

The present invention also relates to the characteristics which will become apparent along the description that follows, and which are to be considered separately or according to all of their possible technical combinations.

BRIEF DESCRIPTION OF DRAWINGS

This description, provided by way of a non limiting example, will help to better understand how the invention can be embodied, with reference to the annexed drawings, in which.

DETAILED DESCRIPTION OF THE PREFERRED EMBODIMENTS

Figure 1:
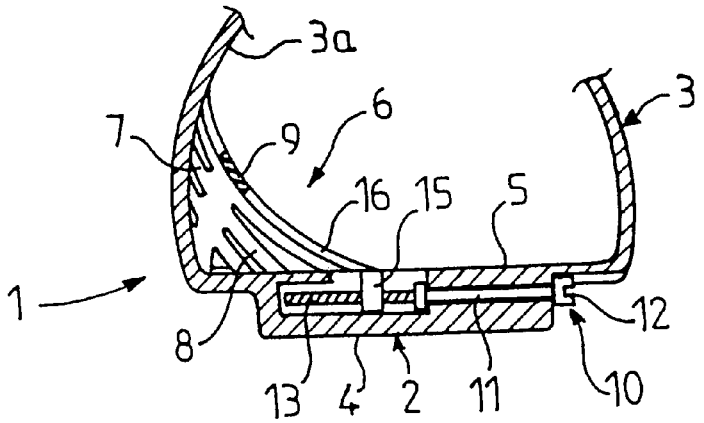
FIG. 1 is a cross-sectional view, along the line I—I of FIG. 2, of a boot that is schematically and partially shown, and is provided with a portion for supporting the arch of a user's foot according to the invention.

The sport boot 1 shown in FIG. 1 includes a sole generally designated by reference numeral 2 and overlaid by an upper 3 (not entirely shown in the figure). In this case, the sole 2 and upper 3 shown in the figures form a shell-shaped monoblock portion. These two parts of the boot could also be constituted by totally distinct elements assembled subsequently by adhesion, a seam, etc. The upper 3 could also be a flexible upper.

The sole or foot support 2 includes an external sole portion 4 and an internal support surface 5 that positioned directly beneath the foot and that carries a supporting portion 6 for the arch of the user's foot. An internal sole referred to as comfort sole (not shown in the drawing) can be interposed between the portions 5, 6, and the user's foot.

According to the invention, the supporting portion 6 is constituted by a flexible, elastically deformable element positioned between the internal surface 5 and an internal lateral flank or wall 3*a* of the upper 3. By internal lateral flank here is meant the flank of the upper located on the medial side of the foot.

The supporting portion 6 includes volume adjusting mechanism or system 10 which it demarcates with the internal surface 5 and the upper 3.

These act on the contour of this volume along one or more transverse planes with respect to the longitudinal axis L of the foot or of the boot.

By activating the adjusting mechanism 10, one undertakes the modification of this profile, therefore of the volume which it demarcates to adapt it to the profile of the arch of the user's foot as a function of the shape of the arch, within the limits of a predetermined adjustment range.

According to another characteristic of the invention, the supporting portion 6 is constituted by a plurality of transverse support or blades or tongues 7 and 8 that are elastically deformable and extend on respective sides of a portion in the form of an arc or longitudinal median arch 9, connecting these support blades 7, 8. The ends 7*a* of support blades 7 are in free contact with the internal lateral wall 3*a* of the upper 3, and the ends 8*a* of the support blades 8 are in free contact with the internal surface 5 on which they are capable of sliding freely, the arch or arcuate section 9 also being elastically deformable in the transverse direction between two binding end points 9*a*, 9*b*, arranged on the upper 3 or on the internal surface 5 via the adjusting mechanism 10 acting on at least one 16 of the support blades.

According to another characteristic of the invention, the adjusting mechanism 10 is constituted by a control screw 11 housed transversely beneath the internal sole 5 and one head 12 of which is in support on an external fixed rigid portion of the boot 1, whereas its other threaded end 13 is in linkage with a threaded remote end 15 of a control blade 16 also coming from the arch 9, such that an action on the control screw 11 in either rotational direction therefore makes it possible to modify the position of the arch 9 in the transverse direction, and thus makes it possible to adapt the arch 9, and therefore the support blades 7 and 8 affixed thereto to the transverse profile of the arch of the user's foot.

In this case, the control screw 11 extends through the thickness of the sole 2, and its head 12 is in support on a lateral edge thereof.

This has the advantage of rendering the adjustment possible from the exterior of the boot.

It must be noted that the freedom remaining at the ends of the blades 7 and 8 has the advantage of allowing these ends to deform freely to assume the contour of the arch of the user's foot and not to become uncomfortable, or even harmful, when the user increases his support, during a thrust for example.

It must equally be noted that according to a preferred embodiment, the control blade 16 is also elastically deformable but has lower elastic flexibility than that of the support blades 7 and 8.

Likewise, the lengths of the support blades 7 and 8 decrease progressively toward either of the longitudinal ends 9*a,* 9*b,* of the median arch 9.

Figure 2:
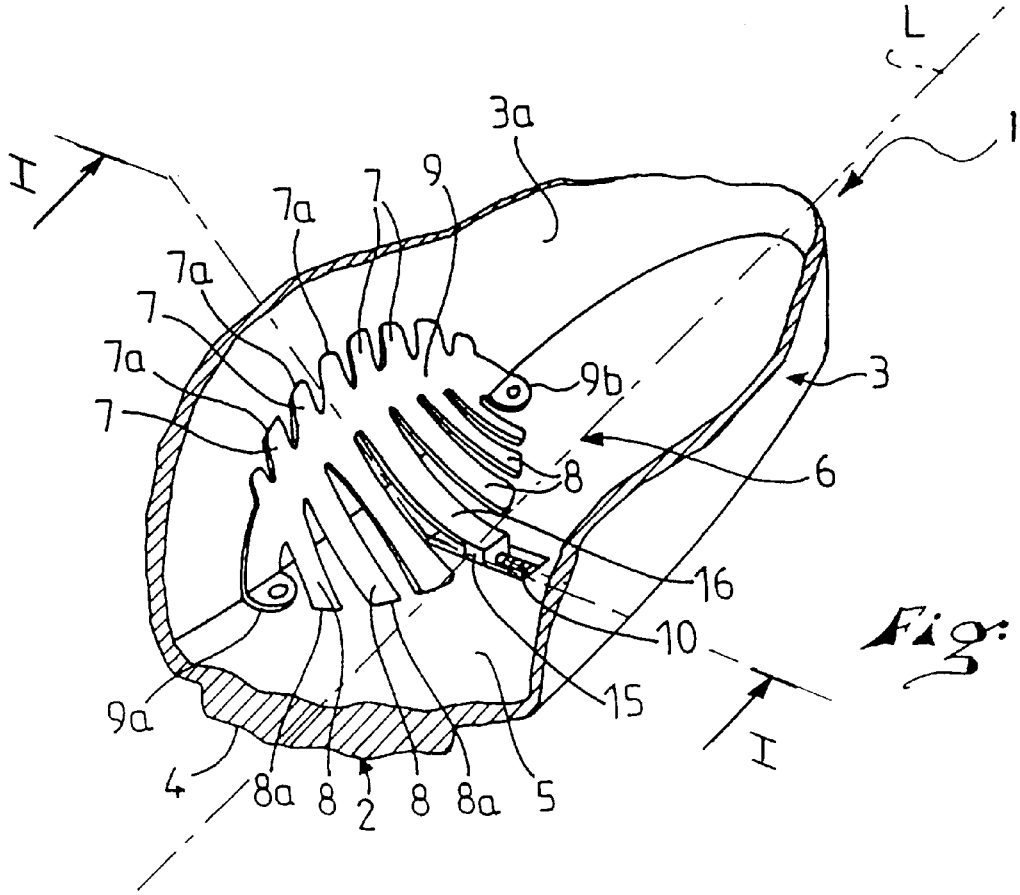
FIG. 2 is a perspective view on an enlarged scale showing the interior of an upper of a boot equipped with a supporting portion according to FIG. 1.

As readily shown in FIG. 2, the supporting portion 6 constituted by the arch 9, the support blades 7 and 8, and the control blade 16, is preferably obtained in one piece, i.e., unitary, by cutting out a flank of plastic material.

Of course, this supporting portion 6 can be obtained by molding a plastic material. In this case, the difference in the rigidity of the various constituent portions can be obtained by varying the thicknesses.

Finally, the overall flexibility of the supporting portion 6 will be determined in relation to the sport involved, and by varying, as previously indicated, the thickness or the type of materials, but also the length, the arrangement and the number of blades 7 and 8 positioned on both sides of the arch.

Figure 3:
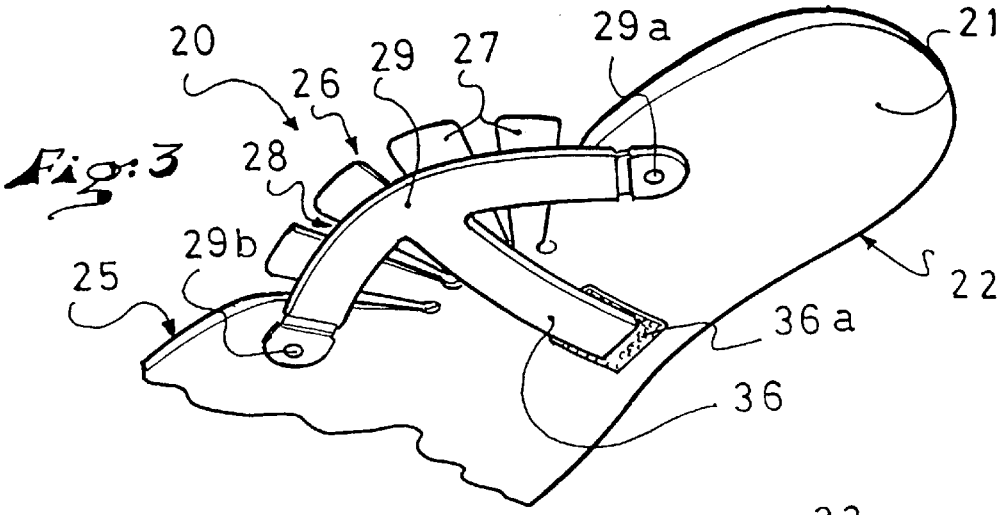
FIG. 3 is a partial, perspective bottom view of an internal sole incorporating a supporting portion for the arch of a foot according to an alternative embodiment of the invention.
Figure 4:
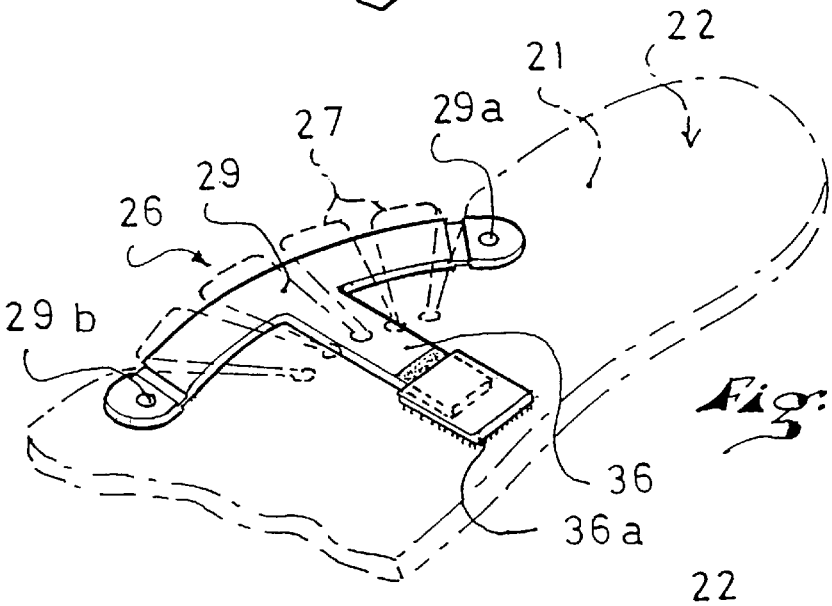
FIG. 4 is a top view of the sole of FIG. 3 in the minimum adjusting position.
Figure 5:
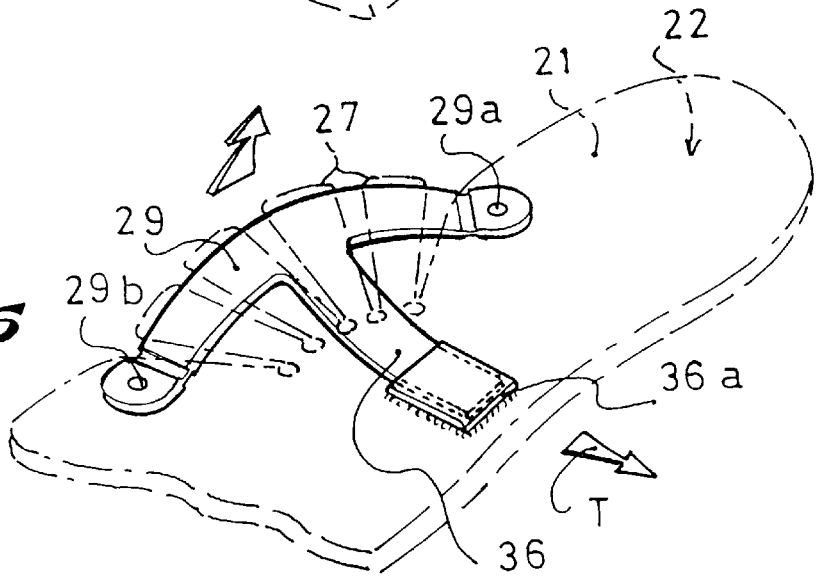
FIG. 5 is a view similar to FIG. 4, in the maximum adjusting position.

FIGS. 3–5 show the incorporation of the system 20 for adjusting the arch of the foot according to the invention into an internal sole 22, this internal sole or foot support 22 having an upper support surface adapted to receive the foot and defining the internal support surface 25 of the foot.

It also has a tower support surface 21 adapted to come into support against the bottom of the boot.

In the zone adapted to receive the arch of the user's foot, this sole 22 has a deformable arch area or zone 26 constituted by transverse tongues or blades 27 arranged in a fan order and separated by gaps 28.

The adjustment system 20 itself is fixed on the lower surface 21 of the sole. This system 20 is constituted by a piece 20 in the form of a flexible and elastically deformable arc, or arcuate section, arranged along the contour of an arch of a foot, beneath the deformable zone 26. This piece 29 is anchored at each end 29*a,* 29*b,* respectively, on both sides of the zone of the arch of the foot, on the lower surface 21 of the sole.

The anchors 29*a,* 29*b* are provided so as to allow for a certain deformation of the arc-shaped piece 29 along a direction perpendicular to the plane of the sole.

A control blade 36 extends substantially radially from the middle of the arc-shaped form 29 in a substantially transverse direction of the sole.

A latching element 36*a* of the self-gripping type, for example, is provided at the free remote end of the control blade 36 and cooperates with a complementary latching element of the internal surface of the sole to provide an adjustment mechanism to immobilize the blade with respect to the sole.

The functioning of this adjustment device is the same as that explained previously in connection with FIGS. 1–2.

Thus, as particularly shown in FIGS. 3–5, a traction on the control blade 36 along direction T, i.e., in the direction of the external or lateral side (as opposed to medial side) of the sole, will cause a tensioning of the arc-shaped piece 29 which will then deform vertically, i.e., upwardly with respect to the internal sole 22, by lifting the tongues 27 located above.

Depending on the tension applied on the control blade 36, the deformed zone of the sole for the arch of the foot will be modified and adapted to the morphology of the user.

In the absence of any tension, the zone for the arch of the foot will correspond to the preformed zone of the sole, as shown in FIG. 4.

Such a construction of the internal sole is particularly adapted for boots with a flexible upper.

Of course, the type of support offered by the zone of the arch of the foot can be modified as a function of the material and shape of the arch.

The present invention is not limited to the embodiments described hereinabove by way of non-limiting examples, but encompasses all equivalent embodiments.

The instant application is based upon the French Priority Patent Application No. 96.06573, filed on May 22, 1996, the disclosure of which is hereby expressly incorporated by reference thereto, and the priority of which is hereby claimed under 35 U.S.C. §119.

What is claimed:

1. An arch adjusting device comprising:

a longitudinally extending foot support;

a flexible, elastically deformable longitudinally extending arc, said arc having opposite longitudinal ends fixedly attached to said foot support;

a control blade unitary with said arc and extending transversely from a center portion of said arc to said foot support, said control blade terminating at an end at said foot support;

a plurality of transverse support blades having respective portions extending transversely from said arc;

said flexible, elastically deformable longitudinally extending arc and said support blades having a profile adapted to be adjusted; and an adjusting mechanism mounted to said foot support and connected to said end of said control blade to enable selective positioning of said end of said control blade in a transverse direction to thereby adjust said profile of said arc and said support blades.

2. An arch adjusting device according to claim 1, wherein:

said support blades are unitary with said arc; and a first plurality of said support blades extend from a one side of said arc toward said foot support and a second plurality of said support blades extend from a second, opposite side of said arc.

3. An arch adjusting device according to claim 1, wherein:

said foot support comprises an internal sole having a deformable zone constituted by said support blades; and said arc is separate from said support blades and is positioned beneath said support blades.

4. A boot comprising an arch adjusting device according to claim 1.

5. A boot comprising:

an upper having an internal lateral wall;

a sole overlaid by said upper, said sole extending along a longitudinally axis;

an internal support surface for supporting the foot;

a flexible, elastically deformable supporting portion extending between said internal support surface and said internal lateral wall of said upper;

said supporting portion comprising a longitudinally extending median arch and a plurality of elastically deformable support blades unitary with said arch and extending transversely on opposite sides of said arch, a first plurality of said support blades having free ends in sliding contact with said internal lateral wall of said upper and a second plurality of said support blades having free ends in sliding contact with said internal support surface, said longitudinal median arch having opposite longitudinal ends fixedly attached to said boot;

said arch and said elastically deformable transverse support blades having a profile adapted to be adjusted;

one of said support blades constituting a control blade; and a volume adjusting mechanism connected to said control blade to act on said control blade in a direction substantially perpendicular to said longitudinal axis to thereby adjust said profile of said arch and said support blades.

6. A boot according to claim 5, wherein:

said volume adjusting mechanism is mounted on said internal support surface.

7. A boot according to claim 5, wherein:

said volume control mechanism comprises a control screw housed transversely beneath said internal support surface; and said control screw includes a head in support on an external fixed rigid portion of the boot and a threaded stem;

said control blade has a threaded end connected to said threaded stem, whereby movement of said control screw in either of two rotational directions acts on said control blade in said substantially perpendicular direction to thereby adjust said profile of said arch and said support blades to adapt to a profile of an arch of the user's foot.

8. A boot according to claim 5, wherein:

said control blade has an elastic flexibility less than other of said support blades.

9. A boot according to claim 5, wherein:

said support blades have respective lengths that decrease progressively in a direction toward either of opposite longitudinal ends of said supporting portion.

10. A boot according to claim 5, wherein:

said arch and said plurality of support blades are unitary.

11. An arch adjusting device comprising:

an internal sole extending substantially along a sole plane, said internal sole having a lower surface and a deformable arch area;

a flexible arc-shaped member extending longitudinally along said deformable arch area, said arc-shaped member having opposite ends attached to said lower surface of said internal sole;

a control member extending transversely from said arc-shaped member to a free end attached to said internal sole;

a latching assembly comprising a first latching element attached to said free end of said control member and a second, complementary latching element attached to said internal sole, said latching assembly securing said control member in an adjustable, determined transverse position, thereby urging said arc-shaped member to deform said deformable arch area with respect to said sole plane.

12. A boot according to claim 11, wherein:

said volume adjusting mechanism is arranged directly on said internal sole.

13. An arch adjusting device according to claim 11, wherein:

said deformable arch area comprises a plurality of transversely oriented tongues separated by transverse gaps to form a deformable fan.

14. An arch adjusting device according to claim 11, wherein:

said arc-shaped member is elastically deformable.

15. An arch adjusting device according to claim 11, wherein:

said control member comprises a blade extending substantially radially from a middle of said arc-shaped member.

16. An arch adjusting device according to claim 11, wherein:

said first latching element and said second, complementary latching element are self-gripping elements.

17. An arch adjusting device according to claim 11, wherein:

said arc-shaped member and said control member are unitary.

18. A boot comprising a flexible upper and an arch adjusting device according to claim 11.

19. An arch adjusting device comprising:

a longitudinally extending internal support surface for supporting the foot;

a flexible, elastically deformable supporting portion, said supporting portion comprising a longitudinally extending arcuate section and a plurality of elastically deformable support blades extending transversely on opposite sides of said arcuate section and comprising opposite longitudinal ends fixedly attached to said internal support surface;

said flexible, elastically deformable supporting portion having a profile adapted to be adjusted;

one of said support blades constituting a control blade; and an adjusting mechanism connected to said control blade to act on said control blade in a transverse direction to thereby adjust said profile of said flexible, elastically deformable portion.

* * * * *